United States Patent [19]

Yu et al.

[11] 4,028,875

[45] June 14, 1977

[54] FALSE-TWIST TEXTURING PROCESS

[75] Inventors: Jing-Peir Yu; Donald G. Gilmer, both of Pensacola, Fla.

[73] Assignee: Monsanto Company, Decatur, Ala.

[22] Filed: Mar. 13, 1975

[21] Appl. No.: 558,033

[52] U.S. Cl. ..... 57/157 TS; 57/34 HS

[51] Int. Cl.[2] ..... D01H 7/92; D02G 1/02

[58] Field of Search ..... 57/34 HS, 157 TS, 157 R, 57/157 S, 77.3

[56] References Cited

UNITED STATES PATENTS

| | | | |
|---|---|---|---|
| 2,891,376 | 6/1959 | Stoddord et al. | 57/34 HS X |
| 3,077,724 | 2/1963 | Stoddord et al. | 57/34 HS |
| 3,165,881 | 1/1965 | Moncuit et al. | 57/34 HS |
| 3,289,400 | 12/1966 | Scragg | 57/34 HS |
| 3,472,011 | 10/1969 | Scragg | 57/157 TS X |
| 3,541,775 | 11/1970 | Fisher | 57/34 HS |
| 3,638,411 | 2/1972 | Tsugawa et al. | 57/34 HS |
| 3,733,801 | 5/1973 | Jones | 57/157 TS |
| 3,785,136 | 1/1974 | Tecce et al. | 57/34 HS |
| 3,796,036 | 3/1974 | Parker | 57/157 TS |
| 3,910,027 | 10/1975 | Bach et al. | 57/157 TS |

*Primary Examiner*—Donald Watkins
*Attorney, Agent, or Firm*—Robert L. Broad, Jr.

[57] ABSTRACT

Thermoplastic multifilament feed yarns, such as polyester feed yarns are heatset in a twisted state at a temperature and under a tension so as to produce a torque yarn; and thereafter continuously, and at substantially the same tension, cooled, detwisted, and subjected to a second heat treatment so as to reduce the torque. If undrawn or partially drawn feed yarn is employed, the yarn may be orientation drawn during the texturing process.

25 Claims, 1 Drawing Figure

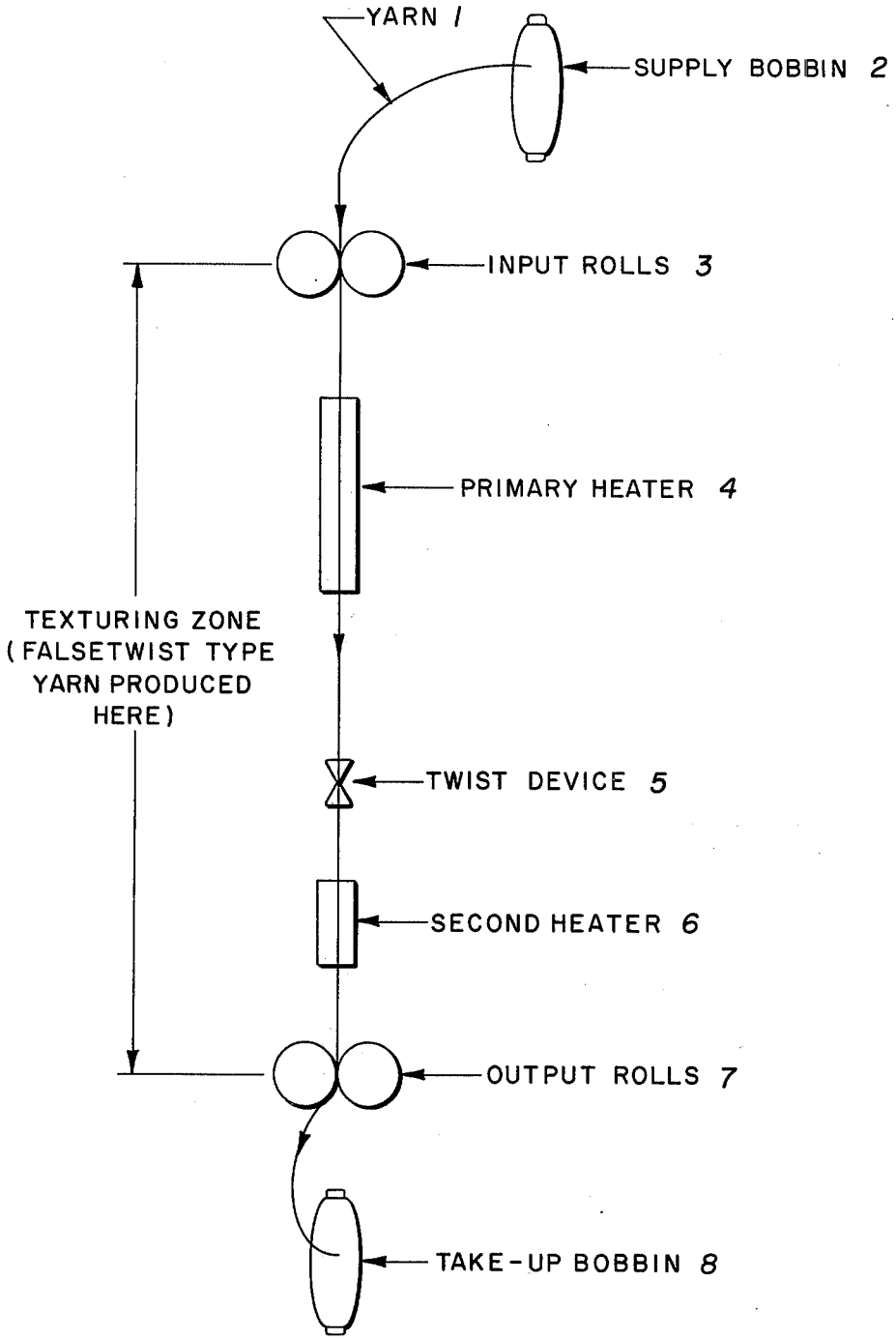
YARN 1
SUPPLY BOBBIN 2
INPUT ROLLS 3
PRIMARY HEATER 4
TEXTURING ZONE
(FALSETWIST TYPE
YARN PRODUCED
HERE)
TWIST DEVICE 5
SECOND HEATER 6
OUTPUT ROLLS 7
TAKE-UP BOBBIN 8

FALSE-TWIST TEXTURING PROCESS

BACKGROUND OF THE INVENTION

A. Field of the Invention

Thermoplastic multifilament feed yarns may be processed into torque yarns and torque yarns may be processed into set yarns. The processing of feed yarns into torque yarns involves the heatsetting of the yarns in a twisted state and under a temperature and tension so as to substantially preclude ductility in the cooled yarn. The reduction of the torque usually follows in either a continuous or discontinuous process, whereby, after the yarn is permitted to cool, the twist is removed from the yarn and the torque is reduced by a second heat treatment. Both heat treatments require carefully controlled tension, and the tension normally employed in the first heat treatment is relatively high, and the tension employed in the second heat treatment is relatively low. In a continuous process, separate tension controls contribute to the expense and complexity of the process; moreover, and this is particularly applicable where the first heat treatment is combined with an orientation drawing step, the speed of the yarn as it passes over the second heater at a relatively low tension requires a relatively long heater plate to effectively reduce the torque. If the tension of the yarn over the second heater were increased to that of the tension over the primary heater, the length of the second heater could be substantially reduced, effecting yet another process conservation measure.

B. Description of the Prior Art

The production of thermoplastic false-twist crimped torque yarn is well known in the art, as set forth in such teachings as U.S. Pat. No. 2,803,109, one of the so-called "single-heater patents" wherein crimped, wavy or fluffed yarns, highly twisted straight compact yarns or crepe yarns are produced from drawn or undrawn thermoplastic feed yarns by setting a yarn in a twisted state under sufficiently high tension during the actual heating as to preclude substantially any ductility in the finished yarn when cooled.

It is also well known, as taught in U.S. Pat. No. 3,091,912, that such torque yarns can be processed or reprocessed continuously or discontinuously by subjecting the yarn, after cooling and removal of the twist to a controlled degree of tensile stress with or without correlated heat or both and with or without additional twisting, untwisting or false-twisting, thereby to reduce or substantially eliminate the torque.

One of the reasons for the success of partially oriented polyester for draw-texturing was that the high speed spinning in lieu of full or partial orientation drawing on the conventional spin-draw machines permitted increased production by the fiber producer on the speed limiting winder in terms of total denier wound. The next phase of the yarn processing, as was known, could readily absorb the increased speed required to orientation draw the yarn as well as texture it, and while this separation of the orientation drawing from the spinning phase has increased production overall, it has led to considerably faster operation on the texturing machines. Since the orientation drawing takes place during the heatsetting of the twisted yarn, it is the second phase or second heat treatment which must absorb the increased speed created by the drawing of the yarn. This means that when heatsetting torque yarn in a high speed continuous process, the draw rolls normally between the false-twist device and the second heater are operating at a much higher speed than the feed rolls which are upstream of the primary heater. The increased speed with which the yarn passes the second heater requires a longer surface exposure on the second heater to properly set the yarn, and practical limitations upon the length of the second heater are tantamount to production restrictions. Moreover, it is always desirable as a conservation measure to eliminate any of this expensive machinery which can be dispensed with. Capital expenditure for such machinery is extremely large and frequently cannot be justified without a showing of potential for higher production; and any cost reduction is a practical advance in the art.

SUMMARY OF THE INVENTION

In accordance with the present invention, the disadvantages of the prior art processes are avoided, and tension controls between the primary and second heaters of the texturizing process are eliminated with the resulting overall increase in speed and decrease in the size of the second heater by heatsetting the yarn in a twisted state at a given temperature under correlated tension to preclude ductility in the cooled yarn, thereby producing torque yarn; thereafter continuously and at substantially the same tension, permitting the yarn to cool, causing the yarn to detwist and thereafter reducing the torque with a second heat treatment. This method is normally accomplished by employing a conventional pin-type false-twist spindle or friction false-twister whereby the twist is backed up on the yarn across the first heater at which point the yarn is heatset. As the yarn passes from the first heater to the false-twist spindle, it is cooled. The false-twist spindle removes the twist from the yarn, and the yarn then passes over a second heater whereby the torque is substantially reduced. No tension controls are placed between the primary and the second heater, so the only tension variations are those caused by the passage of the yarn over either of the heaters or the false-twist spindle. Such frictional contacts invariably and to some extent affect yarn tension, but not in the sense that the tension is regulated thereby.

It is an advantage of the invention that the yarn tensioner between the first and second heaters can be eliminated.

It is another advantage of this invention, this resulting from the increased tension over the second heater, that the exposure distance of the yarn to the second heater may be considerably shortened, thereby permitting the use of smaller and less expensive heaters and a considerably lower overall machine height.

It is yet a third advantage that a production speed limitation inherent in the long second heater is totally eliminated. In summary, the entire texturing process is placed in a new technological and economic setting.

BRIEF DESCRIPTION OF THE DRAWING

The drawing illustrates schematically a typical arrangement in accordance with the present invention.

DESCRIPTION OF THE PREFERRED EMBODIMENT

By "torque angle" is meant the angle between the wale line and the coarse line of the knitted fabric. Torque angle is measured on a circular knitted seamless tubing prepared on a Faber Analysis Knitter (F.A.K.) which is manufactured by the Lawson-Hemphill, Inc. The F.A.K. is set at the following conditions:

| | |
|---|---|
| Needle Head | 220 |
| Needles Per Inch | 20 |
| Gear Ratio | 8:1 |
| Needles | 2500 Long Butt |
| Sinkers | 288 High Butt |
| Meterhead | 3.45 Inches |
| Pretension | None |
| Revolutions Per Junction | 500 |

By "detwisting" is meant removal of the twist as by passing through a conventional false-twisting spindle, the effect of which spindle is to back a twist along the yarn line and remove the twist at the spindle itself. Of course there are other methods of twisting and detwisting, but the false twist is much preferred in the practice of this invention due to tension considerations inherent therein.

By "polyester" is meant a manufactured fiber in which the fiber-forming substance is any long chain synthetic polymer composed of at least 85% by weight of an ester of a substituted aromatic carboxylic acid, including but not restricted to substituted terephthalate units,

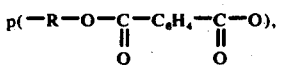

and para substituted hydroxy-benzoate units,

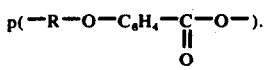

By "partially oriented polyester multifilament feed yarn" is meant yarn which has not been orientation drawn, except to the extent as may be inherent in high speed spinning of the type described in U.S. Pat. Nos. 3,772,872 and 3,771,307.

By "ductility" is meant a permanent increase in the length of the yarn when elongated within the elastic limit of the set twist. The term does not mean the permanent elongation of yarn stretched beyond its elastic limit.

By "thermoplastic yarn" is meant yarns comprised of filaments which will soften when exposed to heat and will harden again when the source of heat is removed.

Referring now to the drawing, yarn 1 is removed from supply bobbin 2 and proceeds through input rolls 3, over primary heater 4, through twist device 5, over second heater 6, and through output rolls 7 to take-up bobbin 8.

Twist device 5 is a false-twist spindle which backs the twist over primary heater 4 where the yarn is heatset. The yarn cools between primary heater 4 and second heater 6. Second heater 6 causes a relaxation of the torque. Tension throughout is controlled by output rolls 7, which serve as draw rolls in the case of a draw-texturing process. Tension variations between input rolls 3 and output rolls 7 are caused only by the frictional effect of the yarn passing over or through the intermediate heaters or the false-twisting device.

Instead of a conventional pin type false-twist spindle, a frictional false-twist unit may be employed. Both frictional and conventional pin devices are well known in the art.

EXAMPLES

A 1.452 inches (3.69 cm) diameter hot pin was used as a second heater with multifilament polyester yarn at 400 ypm (365.6 mpm) on a draw texturizer. The yarn contact length on the second heater was about one inch. The draw ratio was 1.79. The primary heater had a length of 40 inches (101.6 cm), and was maintained at a temperature of 230° C. The conventional pin type false-twist spindle was set at a speed to provide a twist on the yarn of 61 tpi (154.94 tpcm). The temperature of the second heater was varied from 23° C (room temperature) to about 165° C. Yarn characteristics are shown in the following Table.

TABLE I

| Examples | Temp. of Second Heater (° C) | Denier Grams | Elongation (%) | Tenacity gm./den. | Torque Angle On Fabric Before Dyeing (degree) | Torque Angle On Fabric After Dyeing (degree) | Dry Bulk (%) | Skein Shrinkage (%) |
|---|---|---|---|---|---|---|---|---|
| 1 | 23 | 159 | 22.2 | 4.16 | 62 | 62 | 83.5 | 6.11 |
| 2 | 165 | 158 | 16.6 | 3.51 | 86 | 74 | 47.9 | 2.87 |
| 3 | 148 | 157 | 21.2 | 4.30 | 84 | 66 | 53.0 | 2.86 |

The product of Example 1 was in effect a torque yarn; that is to say, the torque had not been removed because the temperature of the second heater was insufficient. Examples 2 and 3 reflect a torque angle on the fabric before dyeing of 86° and 84° which is a near removal of torque.

Having thus described our invention and a preferred embodiment thereof, what we desire to claim and secure by Letters Patent is:

1. A method of processing thermoplastic multifilament feed yarn comprising first heatsetting the yarn in a twisted state at a given temperature under correlated tension to preclude ductility in the cooled yarn, thereby producing a torque yarn; thereafter, continuously and at a tension varying with the correlated tension only to the extent caused by heating and twisting, permitting the yarn to cool, causing the yarn to detwist, and thereafter reducing the torque with a second heat treatment the said yarn not being subjected to tension control between said first heatsetting and said second heat treatment.

2. The method of claim 1 wherein the yarn is twisted and detwisted by a false-twist spindle.

3. The method of claim 1 wherein the yarn texturing step includes orientation drawing of the multifilament feed yarn and the correlated tension is the tension required for the orientation drawing.

4. The method of claim 1 wherein the multifilament feed yarn is polyester.

5. The method of claim 4 wherein the polyester yarn is orientation drawn during the texturing step.

6. The method of claim 4 wherein the draw ratio is about 1.3 to about 2.

7. The method of claim 4 wherein the draw ratio is about 1.79.

8. The method of claim 4 wherein the given temperature is from about 170° to 255° C.

9. The method of claim 4 wherein the given temperature is about 230° C.

10. The method of claim 1 wherein the second heat treatment comprises turning the yarn on a hot pin.

11. The method of claim 4 wherein the temperature of the second heat treatment is from about 100° – 255° C.

12. The method of claim 4 wherein the temperature of the second heat treatment is about 165° C.

13. The method of claim 10 wherein the yarn contact length on the pin is about 1 inch.

14. A method of continually processing thermoplastic multifilament torque stretch yarn which has stretch characteristics which have been set at a given temperature by false-twisting a multifilament yarn having thermoplastic qualities by twisting the yarn in one direction and first heating the twisted yarn to a given temperature under correlated tension to preclude ductility and then removing the twist to produce torque stretched yarn, comprising thereafter continuously permitting the torque stretch yarn to cool and then set heating the yarn at a tension varying from the correlated tension only to the extent caused by the false twisting and heating, the said yarn not being subjected to tension control between said first heating and said set heating.

15. The process of claim 14 wherein the yarn is orientation drawn during the process of setting the twist.

16. The method of claim 14 wherein the torque stretch yarn is polyester.

17. The method of claim 16 wherein the polyester yarn is orientation drawn during the process of setting the twist.

18. The method of claim 17 wherein the employed draw ratio is from about 1.3 to 2.

19. The method of claim 17 wherein the employed draw ratio is about 1.79.

20. The method of claim 14 wherein the given temperature at which the twisted yarn is heated is from about 170° – 255° C.

21. The method of claim 14 wherein the given temperature at which the twisted yarn is heated is about 230° C.

22. The method of claim 14 wherein the heating of the torque stretch yarn after the twisting step is over a hot pin.

23. The method of claim 22 wherein the temperature of the hot pin is from about 23° C to 148° C.

24. The method of claim 22 wherein the temperature of the hot pin is 165° C.

25. The method of claim 22 wherein the length of exposure of the yarn to the hot pin is about 1 inch.

* * * * *